United States Patent [19]

Bronstein-Bonte et al.

[11] Patent Number: 4,546,062

[45] Date of Patent: Oct. 8, 1985

[54] POLYMERIC PH-SENSITIVE OPTICAL FILTER AGENTS AND ARTICLES INCLUDING SAME

[75] Inventors: Irena Y. Bronstein-Bonte, Newton; Edward P. Lindholm, Brookline, both of Mass.

[73] Assignee: Polaroid Corporation, Cambridge, Mass.

[21] Appl. No.: 635,734

[22] Filed: Jul. 30, 1984

[51] Int. Cl.[4] ..... G03C 5/54; G03C 1/40; G03C 1/84

[52] U.S. Cl. ..... 430/215; 430/221; 430/236; 430/244; 430/517

[58] Field of Search ..... 430/215, 221, 517, 236, 430/244

[56] References Cited

U.S. PATENT DOCUMENTS 4,452,878 6/1984 Locatell et al. ..... 430/215
4,468,494 8/1984 Barton et al. ..... 430/215

FOREIGN PATENT DOCUMENTS 32086 3/1977 Japan .

OTHER PUBLICATIONS

A. L. Bluhm, J. A. Sousa and J. Weinstein, Journal of Organic Chemistry, vol. 29, pp. 636–640 (1964).

*Primary Examiner*—Richard L. Schilling
*Attorney, Agent, or Firm*—Louis G. Xiarhos

[57] ABSTRACT

Polymeric optical filter agents and products and processes using same are disclosed. The polymeric optical filter agents are pH-sensitive materials comprising a polymeric backbone having a plurality of pendant moieties of the formula (I).

(I)

wherein X is and R is alkyl, aryl, alkaryl or aralkyl; A is hydrogen, alkyl or the radical where each of $Y^1$, $Y^2$ and $Y^3$ is hydrogen or an electron-withdrawing group; and each $Z^1$, $Z^2$ and $Z^3$ is hydrogen or an electron-withdrawing group; with the proviso that, when each of $Z^1$, $Z^2$ and $Z^3$ is hydrogen, said A is a radical wherein at least one of said $Y^1$, $Y^2$ and $Y^3$ groups comprises an electron-withdrawing group. These agents upon contact with alkali are converted from a substantially non-light absorbing form to a highly colored light-absorbing form useful in photographic products.

35 Claims, 5 Drawing Figures

POLYMERIC PH-SENSITIVE OPTICAL FILTER AGENTS AND ARTICLES INCLUDING SAME

BACKGROUND OF THE INVENTION

This invention relates to certain polymeric pH-sensitive optical filter agents and to articles or products including such agents. More particularly, it relates to certain transparent (or substantially non light-absorbing) polymeric materials which are adapted upon contact with alkali to the provision of substantial light-absorbing or opacification functionality.

Various patents, including, among others, U.S. Pat. No. 3,752,692 (issued Aug. 14, 1973 to R. W. Young) and U.S. Pat. No. 3,794,485 (issued Feb. 26, 1974 to S. M. Bloom et al.) describe photographic film units which, after being exposed within a camera, are designed to be removed from the camera for processing. Since a photosensitive element remains light-sensitive during the processing operation, which typically is effected in an alkaline processing composition, one or more opaque layers will generally be provided in the film unit to afford protection of the photosensitive material against further exposure (fogging) by actinic light. Thus, in the aforesaid U.S. Pat. No. 3,752,692, there is disclosed a film unit including a support having thereon an opaque layer comprising dispersed carbon black. In the aforesaid U.S. Pat. No. 3,794,485, there is described a film unit having a layer of dye precursor material which upon contact with aqueous alkaline processing composition forms a colored species to prevent photoexposure when the film unit is removed from a camera for processing. In U.S. Pat. No. 4,269,925 (issued May 26, 1981 to D. H. R. Barton et al.) certain polymeric pH-sensitive optical filter agents having hydrazone moieties are described for application in photoexposed photosensitive elements against the occurence of fogging during in-light development.

It will be appreciated that for certain applications, notably in the production of photographic products, it will be advantageous to provide a layer of transparent (substantially non light-absorbing) polymeric material which can be, as desired, converted to a colored or light-absorbing form capable of providing opacification functionality.

SUMMARY OF THE INVENTION

According to the present invention, there are provided certain polymeric pH-sensitive optical filter agents and products and processes, especially photographic diffusion transfer products and processes, including such polymeric agents.

The polymeric pH-sensitive optical filter agents of the invention are polymers which upon contact with alkali provide substantial light-absorbing or opacification properties. These optical filter agents are polymers which include a pendant moiety of the formula (I):

(I)

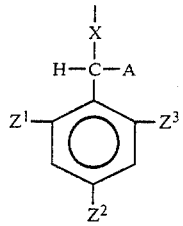

wherein X is

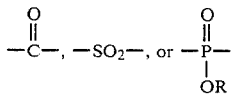

and R is alkyl (e.g., methyl), aryl (e.g., phenyl), alkaryl (e.g., tolyl) or aralkyl (e.g., benzyl); A is hydrogen, alkyl or the radical

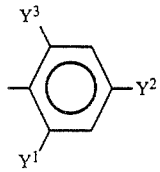

where each $Y^1$, $Y^2$ and $Y^3$ is hydrogen or an electron-withdrawing group; and each $Z^1$, $Z^2$ and $Z^3$ is hydrogen or an electron-withdrawing group; with the proviso that, when each of $Z^1$, $Z^2$ and $Z^3$ is hydrogen, said A is a radical

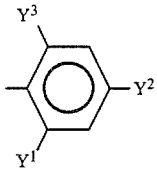

wherein at least one of said $Y^1$, $Y^2$ and $Y^3$ groups comprises an electron-withdrawing group.

The polymeric optical filter agents of this invention are pH-sensitive polymeric indicator dyes having a plurality of moieties of formula (I) possessing spectral absorption characteristics which can be reversibly altered in response to changes in pH. These moieties, integrated with the polymer, have a highly colored form capable of absorbing visible radiation at a pH above the pKa of the moiety. However, the light-absorbing capability of the integrated moieties is substantially reduced (at least in the visible region) at a pH below the pKa of the moiety, with the result that the moieties are substantially in a non-light absorbing form. For the purpose of this invention, pKa means the pH at which about 50% of the moiety is present in its light absorbing form and about 50% is present in its non-light absorbing form.

According to the present invention, polymers comprising the structural moiety of formula (I) are particularly suited for protecting photoexposed photosensitive material from fogging that can occur during in-light development. Polymers containing the structural moiety of formula (I), upon contact with alkali, absorb radiation within wavelength ranges of the visible spectrum and in their colored form provide desired opacification functionality. These polymers can be used alone or in combination with other known pH-sensitive optical filter agents to provide absorption (opacification) over a preselected range or region of the visible spectrum.

The invention as well as details relating to the manners of making and using same, will be more fully appreciated by reference to the following description and certain preferred embodiments of the present invention.

DETAILED DESCRIPTION OF THE INVENTION

Figure 1:
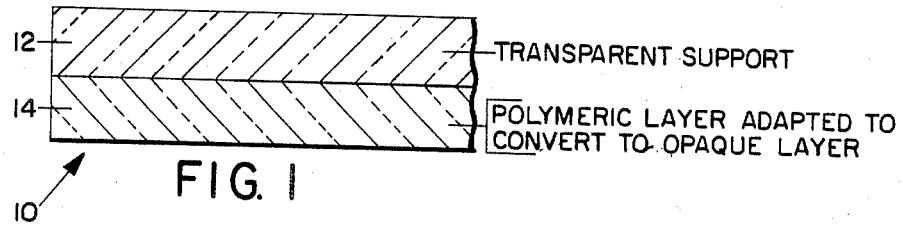
In FIG. 1 is shown a diagrammatic cross-sectional view of an article carrying a layer of polymeric material capable according to the present invention of conversion to an opaque layer.

As indicated above, this invention provides certain polymers which are capable upon contact with alkali of conversion from a substantially non-light absorbing form (at a pH below the pKa of the pendant moieties of the polymer) to a highly colored form (at a pH above the pKa). The polymeric optical filter agents suited to this purpose are polymers which include as a part thereof a plurality of pendant moieties of the formula (I):

(I)

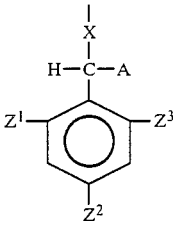

wherein X is

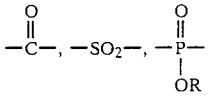

and R is alkyl (e.g., methyl), aryl (e.g., phenyl), alkaryl (e.g., tolyl) or aralkyl (e.g., benzyl); A is hydrogen, alkyl (e.g., methyl) or the radical

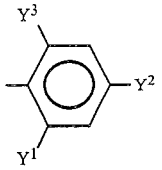

where each $Y^1$, $Y^2$ and $Y^3$ is hydrogen or an electron-withdrawing group; and each of $Z^1$, $Z^2$ and $Z^3$ is hydrogen or an electron-withdrawing group; with the proviso that, when each of $Z^1$, $Z^2$ and $Z^3$ is hydrogen, said A is a radical

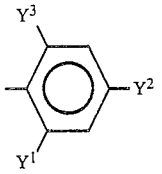

wherein at least one of $Y^1$, $Y^2$ and $Y^3$ groups comprises an electron-withdrawing group. Preferred moieties of formula (I) include those wherein X is carbonyl (i.e.,

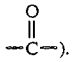

Inspection of the moiety represented by formula (I), i.e., (I)

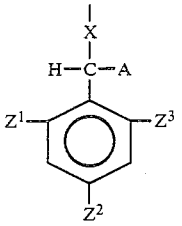

will show the presence of a proton on the carbon atom which interconnects the X moiety and the illustrated aromatic nucleus. This proton, which is abstractable under the influence of alkali is an essential part of the moiety and is believed to be importantly involved in the molecular changes which occur on conversion of the moiety from a substantially non-light absorbing form to a highly colored form. The electron-withdrawing Z groups (and any electron-withdrawing Y groups that may be part of the A moiety) influence the abstraction of the essential proton so that the desired conversion can be effected. In addition, the nature of the X moiety (e.g., carbonyl) and the electron-withdrawing influence thereof allow the pKa of the formula (I) moiety to be sufficiently low, such that, upon contact with alkali, the pKa thereof is readily exceeded with desired conversion of the moiety from a substantially non-light absorbing ("turned-off") form to a highly colored ("turned-on") form.

While applicants do not wish to be bound by any particular mechanism in explanation of the molecular changes which accompany the conversions which are observed, the following is believed to represent some of the changes which occur as the result of the presence of hydrogen and hydroxyl ions:

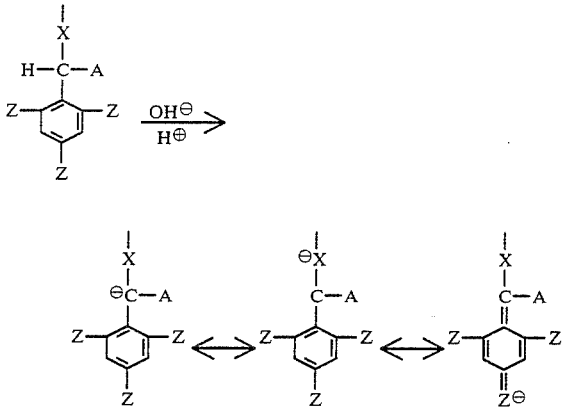

The Z substituents (and the Y substituents that may be part of the A moiety) can be any electron-withdrawing group having a positive sigma value as defined by Hammett's Equation and which are capable of providing a stable anionic resonating structure. Such groups are well known in the art. Exemplary Hammett values and procedures for their determination are set forth by J. Hine in Physical Organic Chemistry, 2nd Edition, p. 87, published in 1962; by H. VanBekkum, P. E. Verkade and B. M. Wepster in Rec. Trav. Chim, Volume 78, Page 815, published in 1959; by P. R. Wells in Chem. Revs., Volume 63, Page 171, published in 1963; by H. H. Jaffe, Chem. Revs., Volume 53, Page 191, published in 1953; by M. J. S. Dewar and P. J. Grisdale in J. Amer. Chem. Soc., Volume 84, Page 3548, published in 1962; and by Barlin and Perrin in Quart. Revs., Volume 20, Page 75 et seq., published in 1966. Suitable Z groups herein include, for example, nitro; trifluoromethyl; acyl (e.g., acetyl, benzoyl); sulfonyl ($—SO_2—R'$ where R' is halogen, alkyl, aryl, alkaryl and acyl, and their substituted derivatives); and sulfonamide (e.g., $—SO_2—NR'R''$, where R' and R'' are each hydrogen or alkyl).

Especially preferred polymeric pH-sensitive optical filter agents are polymers comprising formula (I) moieties containing nitro electron-withdrawing groups.

The moieties of formula (I) are pendant from the polymer backbone and are attached thereto directly or through a suitable linking or spacer group. According to a preferred embodiment of the invention, the polymer will comprise repeating units of the formula (II):

(II)

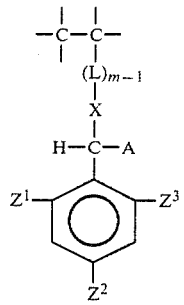

wherein L represents an organic linking or spacer group which serves to link the (I)

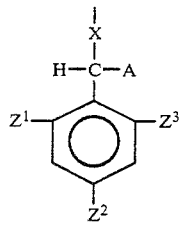

moiety to the polymer backbone; and m is the integer one or two. It will be seen from inspection of the polymer repeat unit of formula (II), that the formula (I) moiety will be attached directly to the polymer backbone when m is one and will be attached to the polymer backbone through linking or spacer group L when m is two. Preferably, m will be the integer two, and spacer or linking group L will be as described hereinafter.

Preferably, the backbone of the polymeric pH-sensitive optical filter agent of the invention will comprise a plurality of interconnected units corresponding to the formula (III):

(III)

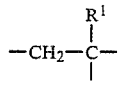

wherein $R^1$ is hydrogen, halogen (e.g., chloro) or alkyl (e.g., methyl). Units corresponding to this formula can be readily provided by conventional ethylenic polymerization of, for example, acrylic or methacrylic monomers.

The nature of organic linking or spacer group L can vary and, for example, can be a divalent radical such as

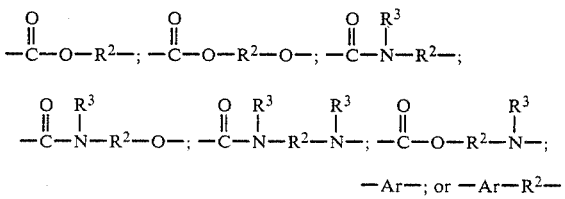

—Ar—; or —Ar—$R^2$—

(wherein $R^2$ in each such radical represents a divalent alkylene radical, such as methylene, ethylene, 1,2-propylene or 1,3-propylene; $R^3$ is hydrogen, alkyl, aryl, alkaryl or aralkyl; and Ar represents an arylene radical such as phenylene or naphthylene). In each of the above L groups containing a carbonyl group, such carbonyl group will be attached to the backbone of the polymer. It will be appreciated that the nature of linking group L, and its molecular configuration and size, can be varied to influence the desired properties of the polymer and the rate at which the pH-induced conversion occurs. The choice of a suitable linking group may in part be influenced by synthetic considerations and ready availability of reactants for production of the polymeric optical filter agents hereof.

A preferred linking group L has the formula

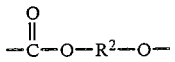

wherein $R^2$ is a divalent alkylene group such as ethylene or 1,2-propylene. Preferred polymers having this linking group are the polymeric ester compounds wherein X is

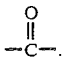

Repeating units of such preferred polymers will have the formula (IV):

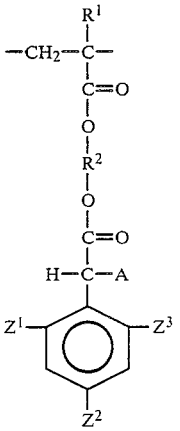

(IV)

wherein $R^2$ is hydrogen, halogen (e.g., chloro) or lower alkyl (e.g., methyl); $R^2$ is alkylene (e.g., 1,2-propylene); and A, $Z^1$, $Z^2$ and $Z^3$ have the meanings described hereinbefore.

The linking group L of the polymers shown in formula (II) can, if desired, be attached to two carbon atoms of the polymeric chain. A suitable example is the radical

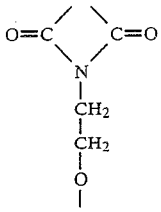

derived, for example, from a polymerizable maleimide. Such a linking group can be present in a repeating unit such as is represented by the following formula

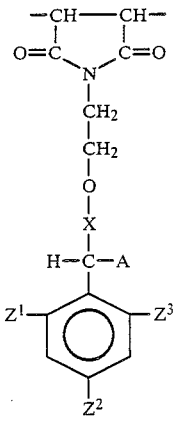

wherein A, X, $Z^1$, $Z^2$ and $Z^3$ have the meanings previously defined.

Polymers comprising repeating units of formula (II)

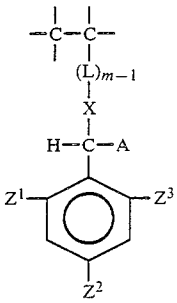

(II)

can be prepared by the polymerization of the corresponding ethylenically-unsaturated monomer. It will be preferred, however, to prepare the polymers by first preparing a polymer having precursor units for the desired units and, thereafter derivatizing to the desired units. In general, this can be accomplished by first preparing a polymer having pendant moieties including a reactive amino or hydroxyl group and, then, derivatizing by reaction of the amino or hydroxyl group with a compound of the formula (V)

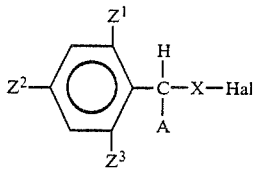

(V)

wherein Hal represents a halogen atom (e.g., chloro) and A, X and Z's are as previously defined. Owing to possible steric influences of Z and A groups, it will normally be preferred to effect the desired derivatization in a stepwise manner using, first, a reactant of formula (V) wherein A is hydrogen, and introducing the desired A moiety into the resulting polymer by a subsequent arylation step. The preparation of certain preferred polymers of the invention having repeating units which include a preferred linking or spacer group L of the formula

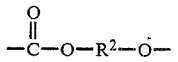

can be illustrated as follows. A polymer having repeating units of the formula (VI)

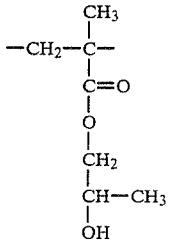

(VI)

is derivatized by reaction (acylation) with a compound of formula (Va)

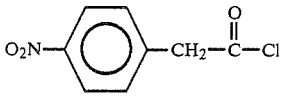

(Va)

to provide a polymer containing repeating units of the following formula (VII)

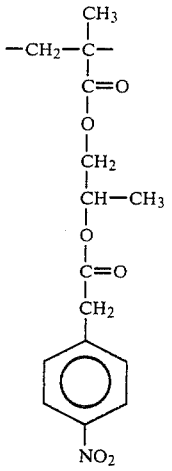

(VII)

An arylation of the polymer containing the formula (VII) repeating units, using a reactant of the formula (VIII)

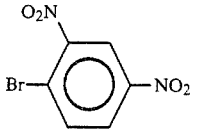

(VIII)

provides a polymer having the preferred repeating units of the formula (IVa)

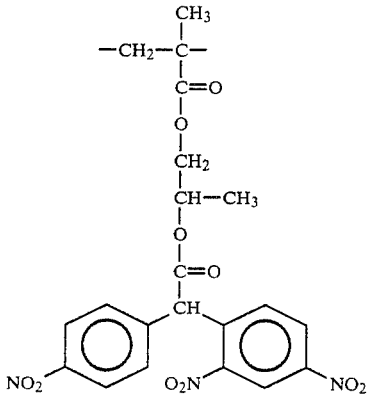

(IVa)

If desired, polymers containing a linking group of the formula

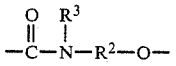

can also be prepared by the derivatization method previously described, using as a starting polymer, a polymer comprising repeating units of the formula

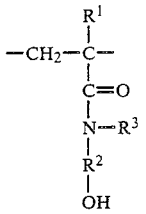

wherein $R^1$, $R^2$ and $R^3$ are as previously described.

The derivatization of a polymer comprising precursor units having a reactive amino group can be appreciated from the following reaction scheme:

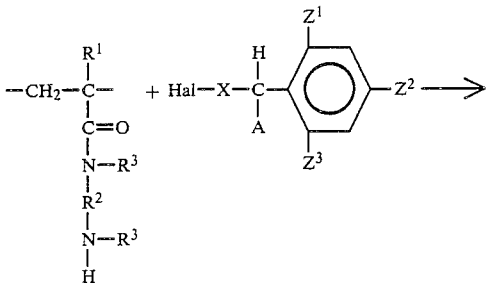

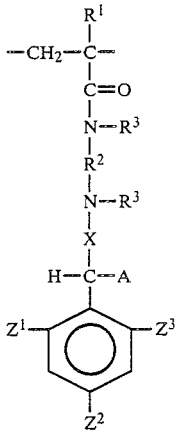

Polymers of the invention can also be prepared, for example, by derivatization of a polymer including repeating units having a reactive halogen atom. This can be illustrated by reaction of a polymer comprising repeating units of the formula

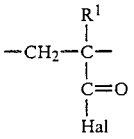

with a derivatizing agent having any of formulas (IX) to (XI):

(IX)

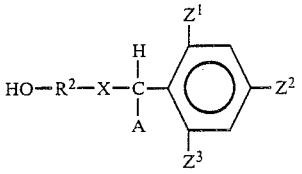

(X)

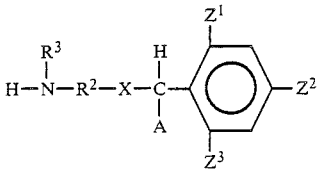

(XI)

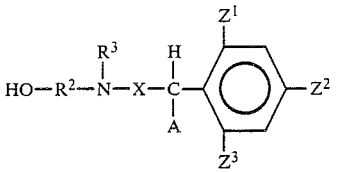

wherein $R^2$, $R^3$, A, X and Z's are as previously defined.

The preparation of polymers comprising repeating units of the following formula (XII)

(XII)

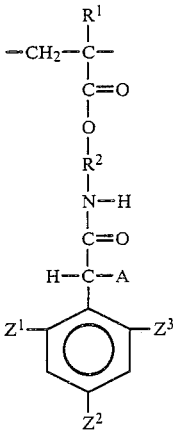

can also be prepared by derivatization of a polymer comprising repeating units of 2-isocyanato-alkyl(meth-)acrylate, as is illustrated in the following reaction scheme:

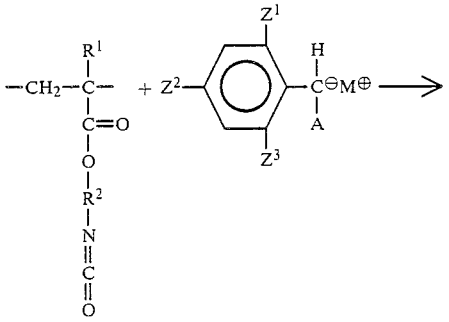

-continued

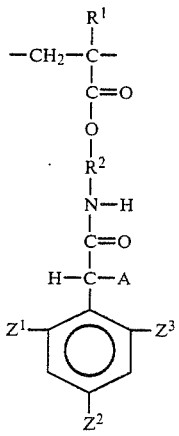

wherein $R^1$, $R^2$, A and Z's have the meanings previously defined and $M^{\oplus}$ is an alkali metal such as sodium. Preferably, $R^1$ is methyl and $R^2$ is 1,2-ethylene.

If desired, polymers having an aromatic linking group L can be prepared. The following is illustrative of a synthetic route to such polymers:

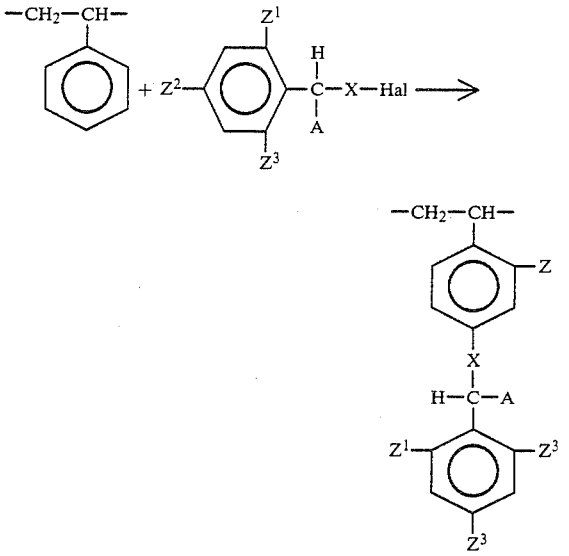

It will be appreciated from the illustrative preparation routes to polymers of the invention that various derivatization reactions can be performed depending upon the nature of the L, X, A and Z moieties desired in the repeating units of formula (II); and suitable preparative routes can be used for the synthesis of polymerizable monomers or derivatized polymer repeating units as desired. While reference is made to the production of polymerizable monomers corresponding to the polymers hereof, it should be understood that the nature of the electron-withdrawing groups Z and Y may cause the monomers to be only difficultly polymerizable. Accordingly, the derivatization of polymeric precursor compounds, as described hereinbefore will be the route of choice to the polymers of the present invention.

Among examples of polymeric pH-sensitive optical filter agents that can be used according to the present invention are polymers which include repeating units having the following formulas:

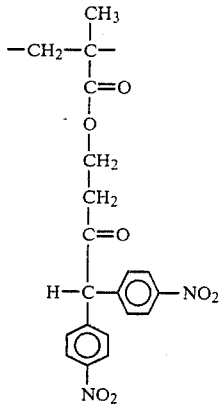

(XIII)

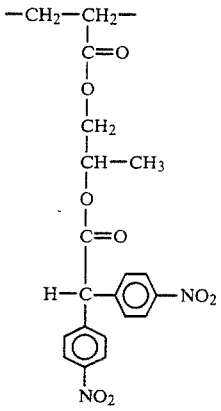

(XIV)

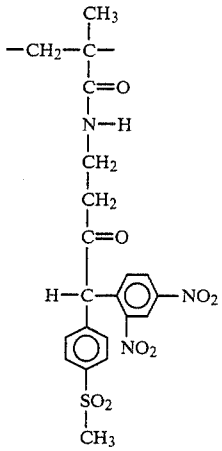

(XV)

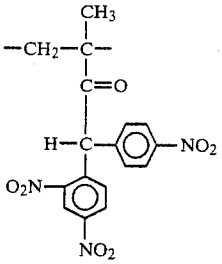

(XVI)

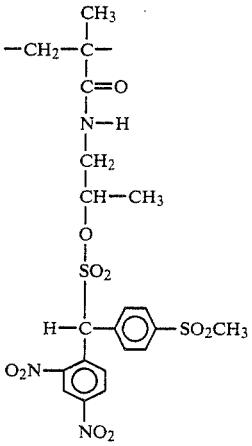

(XVII)

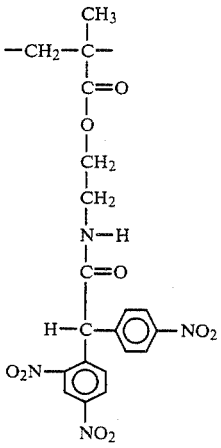

(XVIII)

-continued

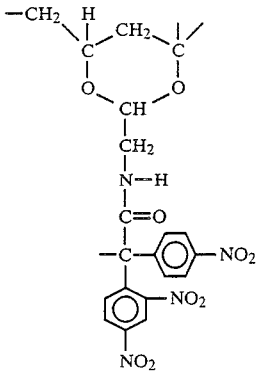

(XIX)

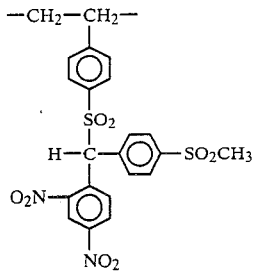

(XX)

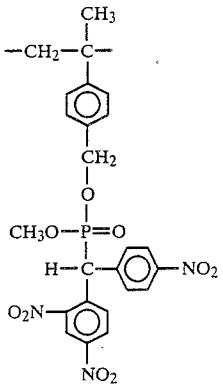

(XXI)

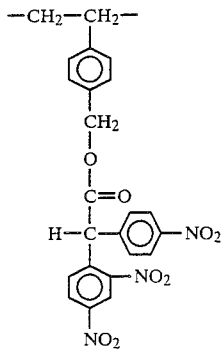

(XXII)

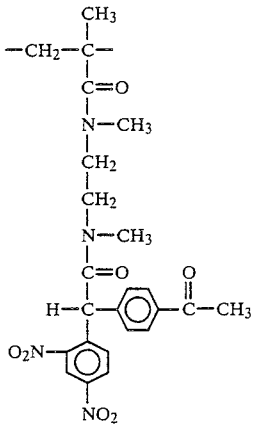

(XXIII)

The polymers herein can be homopolymers or copolymers, including graft or block copolymers. The copolymers can contain units derived from various ethylenically unsaturated monomers such as alkyl acrylates, alkyl methacrylates, acrylamides, and methacrylamides. In general, these comonomeric units are utilized to provide particular predetermined properties to the polymer, such as coatability, solubility, viscosity and permeability of a polymeric layer prepared therefrom.

In general, the polymers employed herein will contain the pH-sensitive repeating units in an amount sufficient to allow for appreciable conversion from a substantially non-light absorbing form to a substantially opaque (highly colored) form. In the copolymers, the proportion of pH-sensitive units to total units will vary depending on the nature of the particular pH-sensitive units employed, the pKa thereof, the nature of the comonomeric or any polymeric material that may be utilized therewith, and upon the particular application and product requirements of characteristics desired.

Examples of copolymeric units suitable in the polymers hereof include the units derived from such ethylenically unsaturated comonomers as acrylic acid; methacrylic acid; 2-acrylamido-2-methylpropane sulfonic acid; N-methyl acrylamide; methacrylamide; ethyl acrylate; butyl acrylate; methyl methacrylate; N-methyl methacrylamide; N-ethyl acrylamide; N-methylolacrylamide; N,N-dimethyl acrylamide; N,N-dimethyl methacrylamide; N-(n-propyl)acrylamide; N-isopropyl acrylamide; N-(β-hydroxy ethyl)acrylamide, N-(β-dimethylamino)acrylamide; N-(t-butyl)acrylamide; N-[β-(dimethylamino)ethyl]methacrylamide; 2-[2'-(acrylamido)ethoxy]ethanol; N-3'methoxy propyl)acrylamide; 2-acrylamido-3-methyl butyramide; acrylamido acetamide; methacrylamido acetamide; 2-[2'-methacrylamido-3'-methyl butyramido]acetamide; diacetone acrylamide; and mixtures thereof.

Illustrative of certain preferred polymeric pH-sensitive optical filter agents of the present invention are the polymers of the formula

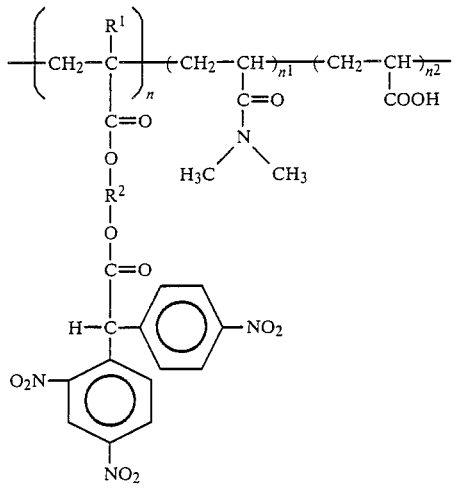

wherein $R^1$ and $R^2$ are as previously defined; and n, $n^1$ and $n^2$ represent the respective molar proportions of such units in the copolymer. The values of n, $n^1$ and $n^2$ can vary. Thus, n can, for example, be in the range of from about 5 to 50 mole percent while $n^1$ represents from about 1 to 50 mol percent; and $n^2$ represents the balance to 100 mole percent, i.e., $[100-(n+n^1\%)]$.

The polymers of the invention exhibit efficient opacification capability in converting from a substantially transparent polymeric layer to a highly colored (light-absorbing) layer. The polymers can be converted to highly colored material by contact with concentrated alkali such as sodium hydroxide, potassium hydroxide or the like. In general, a concentration of about 0.5 to abut 2 molar will be suitable to effect the conversion. It will be appreciated that the particular concentration of alkali required to effect the conversion will vary with the desired and predetermined rate of conversion and the particular polymer employed.

Photographic aqueous alkaline processing compositions customarily utilized in diffusion transfer photographic processing can conveniently be utilized to effect the desired conversion. These compositions are known and, in general, will have a pH in the range of about 13.5 or more. Thus, a transparent layer of pH-sensitive polymeric optical filter agent of the invention can be utilized in a photographic product which is adapted to permit photoexposure of a photosensitive emulsion through the polymeric layer. Upon application of a photographic processing composition typically used in the processing of such a product, the pH-sensitive polymeric layer can be rapidly converted to a highly colored form to provide protection against further photoexposure from the direction of such exposure.

The polymeric pH-sensitive, optical filter agents of this invention are preferably used in diffusion transfer film units as pH-sensitive optical filter agents and manners of using them are known to the art. As mentioned, the primary function of optical filter agents is to provide temporary opacification during processing of a photoexposed film unit. In turn, this function must be accomplished without interfering with photoexposure or photosensitive layer(s) or with viewing the final image. Accordingly, the polymeric optical filter agents of this invention can be utilized in a layer of the film unit between the photosensitive layer(s) and a layer through which the photosensitive layer(s) is exposed. When employed in such a layer, the polymeric, optical filter agent should be maintained at a pH at which the polymeric optical filter agent is substantially non-light absorbing (colorless). After photoexposure, and as the aqueous alkaline processing composition is applied to the polymeric optical filter agent-containing layer, the polymeric optical filter agent will be rapidly converted to a light-absorbing form (colored) to assume its opacification function. If the polymeric optical filter agent-containing layer is positioned so that it may interfere with viewing the image, the polymeric optical filter agent can be converted in known manners—to the non-light absorbing form. If conversion means are not available, the polymeric optical filter agent-container layer should be positioned so that the layer is hidden after image formation. For example, the layer can be hidden by the reflecting layer masking the photoexposed layers.

According to one embodiment of this invention, the polymeric pH-sensitive optical filter agent is included in the aqueous alkaline processing composition with the light-reflecting pigment or agent. In this embodiment, the polymeric optical filter agent is light absorbing (colored) in the distributed processing composition providing the light reflecting layer and remains sufficiently light absorbing during formation of the image to provide the degree of opacification required of the distributed light-reflecting layer. Thereafter, the polymeric filter agent is converted to a form exhibiting a substantially reduced light-absorbing capacity as the pH of the reflecting layer is adjusted to a value below the pKa of the polymeric filter agent. Once converted to its diminished light-absorbing form, the position of the polymeric filling agent with respect to the viewable image is not especially critical. It can, for example, be in front of the light-reflecting layer or in the light-reflecting layer. In this embodiment, the polymeric filter agent used should have good stability in aqueous alkali processing compositions and a high pKa e.g., a pKa of 11 or more.

The polymeric optical filter agents of the present invention exhibit a substantial reduction in light-absorbing capacity upon conversion from a highly colored form at a pH above the pKa thereof to a pH below the pKa. Relative to the highly colored forms, the optical filter agents of the present invention are, thus, substantially non-absorbing in the visible region of the electromagnetic spectrum. Preferably, the optical filter agents will be colorless at a pH below the pKa and, accordingly, will be especially suited to the provision of a white or substantially white background for viewing of the transferred photographic image. Depending, however, upon the particular optical filter agent employed, the nature of substituent moieties present which may contribute light-absorbing capacity, and the concentration of such optical filter agent employed in a light-reflecting layer, a light-reflecting layer containing an optical filter agent of the invention may exhibit a coloration in its relatively and substantially non-absorbing form. The optical filter agents in their highly colored form provide, however, substantial protection of photosensitive elements against post-exposure fogging.

A particularly preferred light-reflecting pigment for film units of this invention is titanium dioxide. In general, the coverage of the titanium dioxide should be such as to provide a percent reflectance of about 85–95%. Particularly preferred processing compositions for the above-described embodiment and including the preferred titanium dioxide are those additionally having enough pH-sensitive indicator dye to provide—on distribution—a layer having an optical transmission density—6.0 density units and an optical reflection density—1.0 density units at a pH above the pKa of the optical filter agent(s).

The amount of polymeric optical filter agent used in film units to provide the desired opacification may be readily determined by routine testing. The amount selected should be sufficient to provide—in combination with other layers between the photosensitive layer(s) and incident radiation—an optical transmission density sufficient to prevent the unwanted fogging during processing. The amount will, of course, vary as a function of, e.g., processing time, light intensity and exposure index. In general, the opacification system should provide an optical transmission density of at least about 5.0 and generally about 6.0 or 7.0 or somewhat higher.

The pH-sensitive polymeric optical filter agents of the invention can be utilized in combination with various other materials in a photographic film unit. For example, other filter agents can be used in conjunction therewith to augment opacification functionally or to provide opacification in a particular and predetermined portion of the visible spectrum. Thus, a yellow dye material can be used in combination with an optical filter agent of the invention to provide absorption (opacification) in the blue region of the visible spectrum. A pH-sensitive yellow dye material that can be used for this purpose is a polymeric acetal comprising repeating units of the following formula (XXIV):

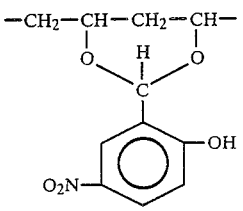

(XXIV)

Such acetal polymer can be prepared by the derivatization of polyvinyl alcohol by reaction in dimethylformamide with a 50% stoichiometric excess of 2-hydroxy-5-nitrobenzaldehyde. The polymer can be combined with a pH-sensitive optical filter agent of the invention and coated from water or a water/alcohol solvent mixture to provide a layer suited to application as an opacification layer in a film unit of the invention.

Referring to FIG. 1, there is shown a diagrammatic cross-sectional representation of an article 10 of the invention comprising a transparent support 12 carrying a transparent layer 14 of the pH-sensitive polymeric optical filter agent of the present invention. Article 10 can, for example, be employed for the production of any of a number of photographic products. For example, as shown in photosensitive article 20 of FIG. 2, actinic light is transmitted through a transparent layer 24 of a polymer of the present invention and through a transparent support 22 to photoexpose a photosensitive layer 26 such as a silver halide emulsion layer. After photoexposure, photosensitive article 20 can be contacted with an alkaline solution such that polymeric layer 24 thereof is converted to a highly colored (opaque) layer. This highly colored layer permits photosensitive article 20 to be removed from a camera to conditions of ambient light and provides protection of photosensitive layer 26 against further exposure (fogging) from the exposure direction. It will be appreciated that means for protecting photosensitive layer 26 against further exposure from the opposed direction upon removal of photosensitive article 20 to conditions of ambient light can be provided by an opaque layer (not shown) such as a cover sheet positioned over photosensitive layer 26.

Figure 2:
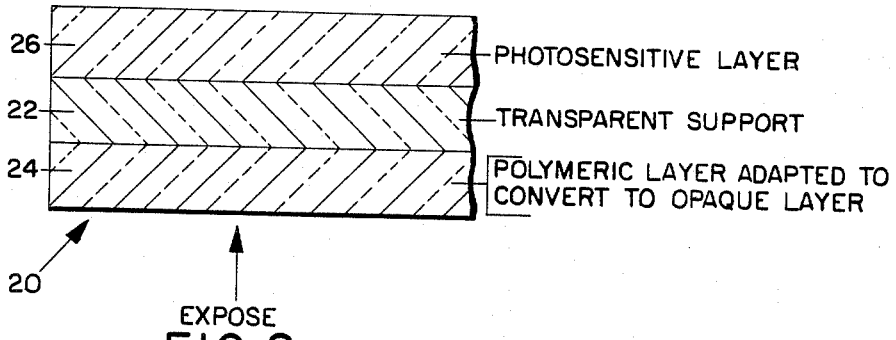
In FIG. 2 is shown a diagrammatic cross-sectional view of an article such as is shown in FIG. 1, additionally including a photosensitive layer.
Figure 3:
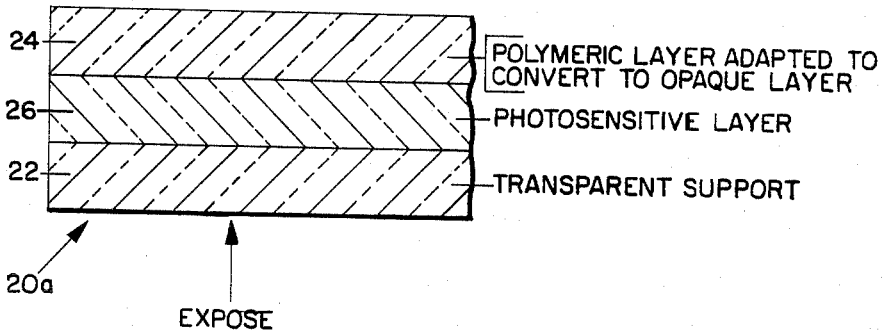
In FIG. 3 is shown a diagrammatic cross-sectional view of an article including, in an alternative arrangement, the elements of the article of FIG. 2.

In FIG. 3 is shown an article of the invention comprising an alternative arrangement of the elements of photosensitive article 20 of FIG. 2. Thus, in FIG. 3 is shown a photosensitive article 20*a* comprising a transparent support 22 carrying a photosensitive layer 26, and thereover, a transparent layer 24 of a pH-sensitive polymeric optical filter agent of the invention. After photoexposure of photosensitive layer 26, through transparent support 22, photosensitive article 20*a* can be contacted with an alkaline solution to convert pH-sensitive polymeric layer 24 to a highly colored (opaque) layer. The highly colored layer protects photosensitive layer 26 against exposure (fogging) and allows articles 20*a* to be removed from a camera into ambient light after desired photoexposure, provided that means such as an opaque sheet (not shown) is positioned over transparent support 22 so as prevent further exposure (from the exposure direction) of photosensitive layer 26 upon such removal.

If desired, support 22 can be an opaque support material, in which case, photosensitive layer 26 can be photoexposed from the direction of transparent pH-sensitive polymeric layer 24. Layer 24 can then be converted by alkali to an opaque layer and the resulting article can be brought into ambient light.

Figure 4:
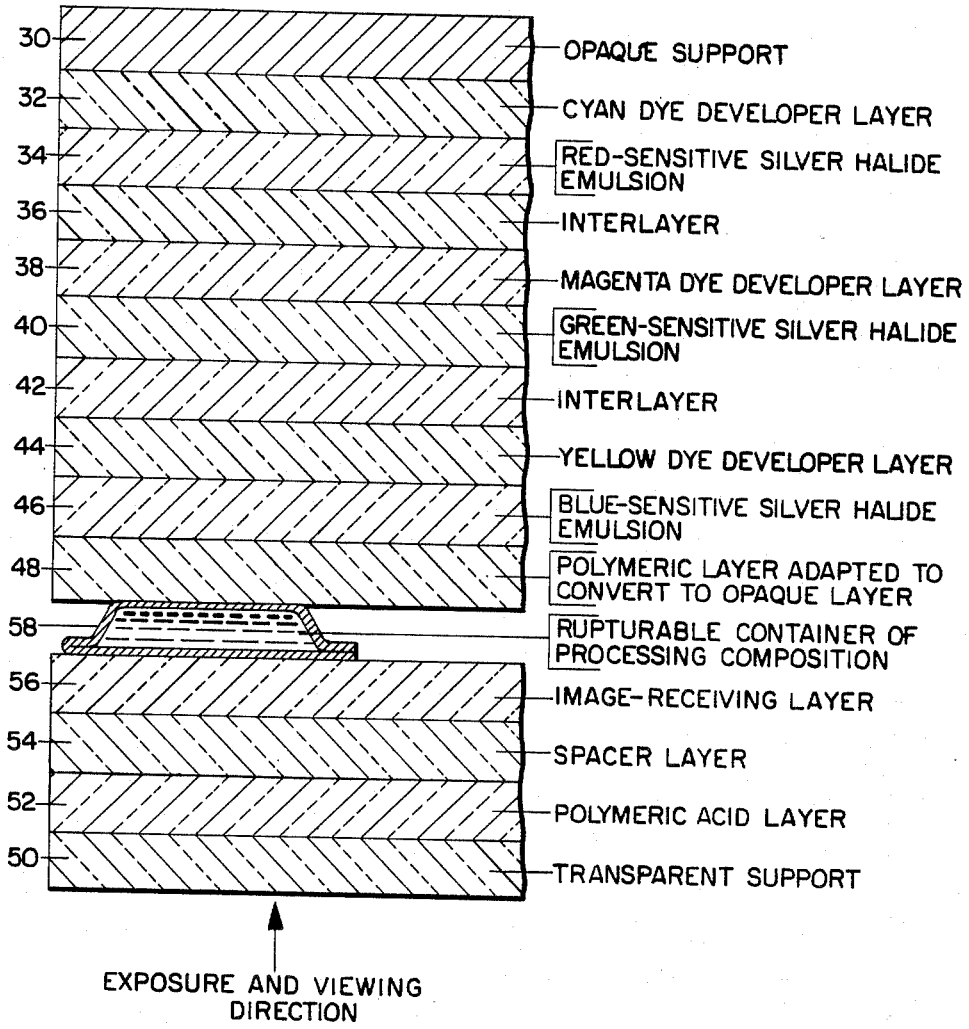
In FIG. 4 is shown a diagrammatic cross-sectional view of a diffusion transfer film unit illustrating one embodiment of the present invention.

Referring now to FIG. 4, there is shown a preferred film unit of this invention wherein an opaque film support 30 carries, in order, a layer 32 of a cyan dye developer, a layer 34 of a red-sensitive silver halide emulsion, an interlayer 36, a layer 38 of a magenta dye developer, a layer 40 of a green-sensitive silver halide emulsion, an interlayer 42, a layer 44 of a yellow dye developer, a layer 46 of a blue-sensitive silver halide emulsion and a layer 48 of transparent pH-sensitive polymer optical filter agent of the invention. A second support 50 (transparent) carries a polymeric acid layer 52, a spacer or timing layer 54, and an image-receiving layer 56. Following photoexposure through the transparent support 50 and the layers carried thereon, the container 58 is ruptured and the processing composition contained therein is distributed between the opposing surfaces of layers 48 and 56. Contact by the alkaline processing composition is effective to cause the pH-sensitive layer 48 to be converted to a highly colored (opaque layer). The processing composition in container 58 includes a light-reflecting material, e.g., titanium dioxide pigment and a light-reflecting layer is thereby provided between layers 48 and 56.

During at least the initial stage or stages of processing, the layer provided between layers 48 and 56 is subjected to an environmental pH which is above the pKa of the polymeric optical filter agent of layer 48, and under such pH conditions, the optical filter agent is highly colored and light-absorbing. Accordingly, during this state of processing, the polymeric, light-absorbing optical filter agent cooperates with the light-reflecting layer to provide opacification sufficient to protect the photosensitive system (comprising layers 34, 40 and 46) from further photoexposure through transparent support 50. The film unit can, thus, be ejected from a camera into ambient light.

The processing composition initiates development of the photoexposed photosensitive layers in manners well known to the art to establish an imagewise distribution of diffusible image-providing material which can comprise silver and/or one or more dye image-providing materials. The diffusible, image-providing material is transferred through the permeable, light-reflecting layer and is mordanted, precipitated or otherwise retained in known manner in or on image-receiving layer 56 to provide a transfer image viewable through transparent support 50 against the light-reflecting layer.

Film units of the type shown in FIG. 4 include means to reduce the pH of the film unit to a predetermined level. The means to effect this reduction in pH is shown in FIG. 4 as a substantially transparent polymeric acid neutralizing layer 52 of the type described in U.S. Pat. No. 3,415,644. As shown in FIG. 4, polymeric acid neutralizing layer 52 is used in combination with a spacer or timing layer 54 positioned between the neutralizing layer 52 and image-receiving layer 56. If desired, neutralizing and spacer layers 52 and 54 can be present in the photosensitive element, for example, between support 30 and cyan layer 32.

Polymeric acid neutralizing layer 52 is designed to function after distribution of the aqueous alkaline processing composition. After a predetermined period, alkaline reagents diffuse to and through spacer layer 54 and are neutralized by contact with polymeric acid layer 52. This neutralization continues until the environmental pH of the film unit is reduced to a predetermined value—preferably to a pH of about 5 to 8. The neutralization is sufficient to at least reduce the environmental pH of the polymeric optical filter agent to a pH below the pKa value of the polymeric optical filter agent in layer 48. At this reduced pH, the light-absorbing capability of the polymeric, pH-sensitive, optical filter agent is reduced and becomes substantially non-absorbing of visible light. The layer provided by distribution of the processing composition (including light-reflecting pigment material) serves, however, to mask layer 48 and the developed emulsion layers therebehind. It also provides a background for the viewing of an image in layer 56 through transparent polymeric acid layer 52, transparent spacer layer 54 and transparent support 50.

Figure 5:
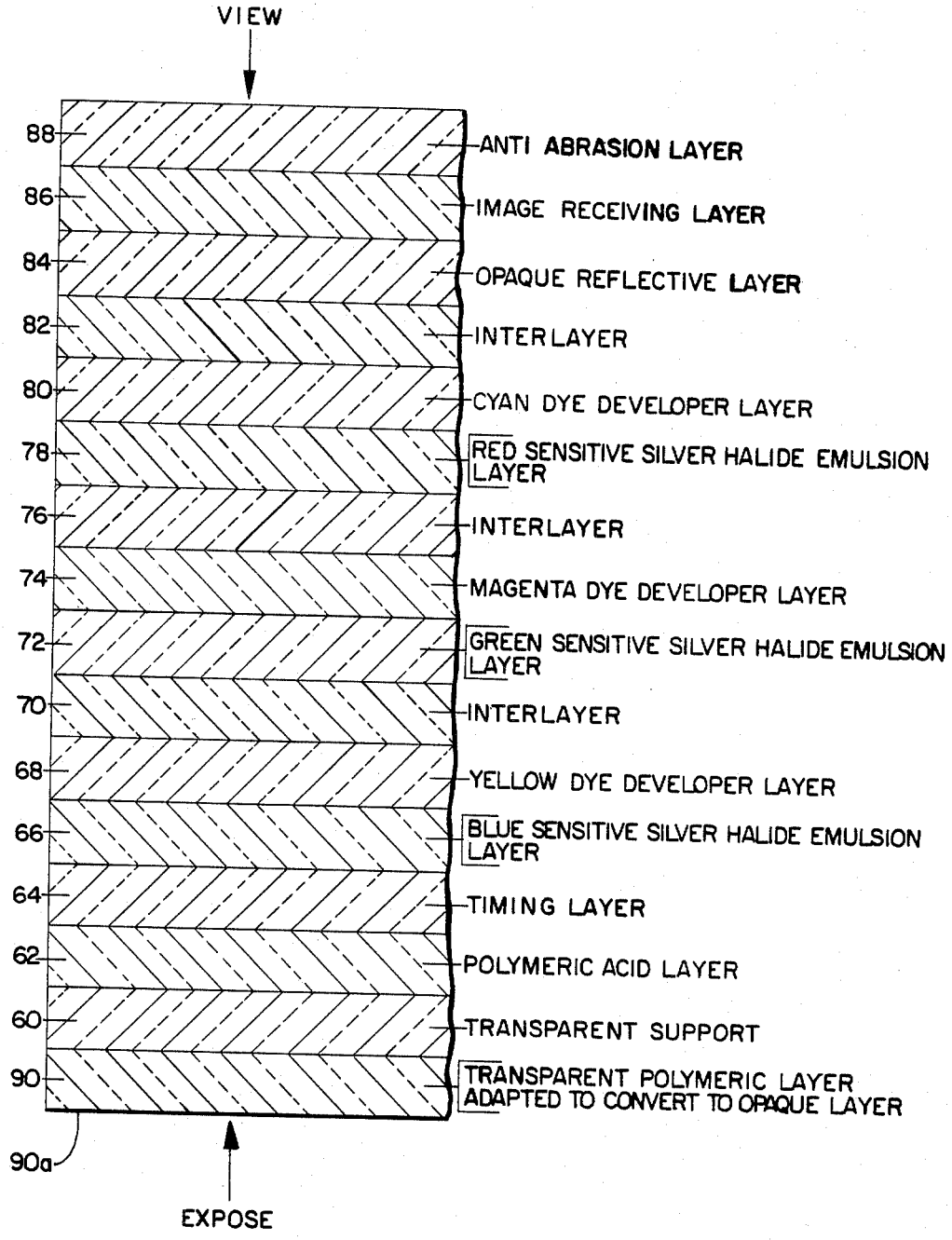
In FIG. 5 is shown a diagrammatic cross-sectional view of another embodiment of a diffusion transfer film unit of the present invention.

In FIG. 5, is shown another embodiment of the present invention in the form of a photographic diffusion transfer film unit, including as a layer thereof a layer of a polymer of the present invention adapted upon contact with alkali to be converted from a transparent layer to a substantially opaque layer. In the film unit of FIG. 5, the various layers thereof are shown on a single support layer. It will be appreciated, however, that other arrangements of layers can also be utilized to provide a photographic film unit including a polymeric pH-sensitive optical filter agent of the present invention.

Referring to FIG. 5, there is shown a film unit comprising transparent support 60 carrying on a first side thereof a layer 90 of pH-sensitive polymeric optical filter agent of the invention. On the opposed side of support layer 60, is shown a polymeric acid neutralizing layer 62, timing layer 64, a blue-sensitive halide emulsion layer 66, a yellow dye developer 68, an interlayer 70, a green-sensitive silver halide emulsion layer 72, a magenta dye developer layer 74, an interlayer 76, a red-sensitive silver halide emulsion layer 78, a cyan dye developer layer 80, an interlayer 82, an opaque/reflective layer 84 (which preferably contains a white pigment such as titanium dioxide to provide a white background against which the image is viewed, and an opacification agent such as carbon black), an image-receiving layer 86 and an anti-abrasion layer 88.

Photoexposure of the silver halide emulsion layers is effected through the transparent pH-sensitive polymeric layer 90 and through transparent support 60 and the layers carried thereon, i.e., the polymeric acid layer 62 and the spacer or timing layer 64, which layers are also transparent, the film unit being so positioned within the camera that light admitted through the camera exposure or lens system is incident upon the outer or exposure surface 90*a* of the polymeric layer 90 of the present invention.

After photoexposure, the film unit is immersed in an aqueous alkaline processing composition. After a suitable imbibition period, e.g., in the range of about 40 to 120 seconds, the transparent polymeric layer 90 is converted by the alkaline processing to a highly colored (opaque) layer. In addition, development of emulsion layers 66, 72 and 78 is initiated by contact with the processing composition. If the film unit is removed from the processing composition to conditions of ambient light, the still photosensitive and developing emulsion layers thereof are protected against additional photoexposure by ambient or environmental light through transparent support 60 by the now opaque layer 90. The emulsion layers are protected against additional photoexposure from the opposed (or image-viewing) side of the film unit by opaque reflective layer 84.

In exposed and developed areas, the dye developers are oxidized as a function of the silver halide development and are immobilized. Unoxidized dye developer associated with undeveloped and partially developed areas remains mobile in transferred imagewise to the image-receiving layer 86 to provide the desired positive image therein.

Permeation of the alkaline processing composition through the several layers of the film unit is controlled so that the process pH is maintained at a high enough level to effect the requisite development and image transfer and to convert the polymeric layer 90 to a highly colored form, after which, pH reduction is effected as a result of alkali permeation into the polymeric acid layer 62 such that the pH is reduced to a level which stops further dye transfer. Layer 90, after having been rendered opaque by the action of alkali, is converted by the neutralization and reduction of environmental pH to a layer which is substantially non-absorbing of visible light. At this reduced pH, which is below the pKa of the polymeric optical filter agent, the optical filter agent is in its substantially non-light absorbing form. The image in dye developer present in the image-bearing layer 86 is viewed through the anti-abrasion layer 88 against the reflecting layer 84 which provides an essentially white background for the dye image and also effectively masks from view the developed silver halide emulsion layer and dye developer immobilized therein or remaining in the dye developer layers.

In the embodiment illustrated in FIG. 5, image-receiving layer 86 (and reflecting layer 84 against which the image is viewed) are shown as layers carried by a single support layer 60. While this is a particularly useful and preferred embodiment, image formation can be accomplished in a separate image-receiving element comprising a transparent or opaque (e.g., baryta) support and an image-receiving layer. The image-receiving element may be brought into superposed relation with a photosensitive element comprising layers 90 through 84, either before or after photoexposure thereof. Polymeric layer 90 can be rendered opaque and development can be initiated by contact with an aqueous alkaline processing composition. The image-receiving element can be left intact for viewing through the transparent support thereof a reflection print against reflective layer 84. Alternatively, the image-receiving element can be separated for the viewing of a transparency or reflecting print, respectively, in the case of a transparent or opaque (e.g., baryta) image-receiving element support.

According to another embodiment, transparent polymeric layer 90 can, if desired, be positioned between transparent support 60 and polymeric acid layer 62. It will be appreciated, however, that owing to the amount of time required for alkali to permeate the several layers of the film unit so as to permit coversion of transparent layer 90 to an opaque layer, the positioning as shown in FIG. 5 will be preferred. As indicated hereinbefore, other arrangements of layers can be suitably employed to provide photographic images by diffusion transfer products and processes utilizing a pH-sensitive substantially transparent polymeric optical filter agent of the invention.

Film units which include a layer adapted to conversion to a substantially opaque layer and whch are adapted to utilization of a pH-sensitive polymeric optical filter agent hereof are described in the application of J. G. Bullitt et al., U.S. Ser. No. 624,270, filed June 25, 1984.

In the description of diffusion transfer film unit embodiments of this invention, reference has been made for convenience, to the use of dye developers and the formation of positive transfer images. In diffusion transfer embodiments of the invention, the diffusible image-providing substance may be a complete dye or a dye intermediate, e.g., a color coupler. The preferred embodiments of this invention use a dye developer, that is, a compound which is both a silver halide developing agent and a dye disclosed in U.S. Pat. No. 2,983,606, issued May 9, 1961 to Howard G. Rogers. As is now well known, the dye developer is immobilized or precipitated in developed areas as a consequence of the development of the latent image. In unexposed and partially exposed areas of the emulsion, the dye developer is unreacted and diffusible and thus provides an image-wise distribution of unoxidized dye developer, diffusible in the processing composition, as a function of the point-to-point degree of exposure of the silver halide emulsion. At least part of this imagewise distribution of unoxidized dye developer is transferred, by imbibition, to the superposed image-receiving layer to provide a reversed or positive color image of the developed image. The image-receiving layer contains a mordant to mordant transferred unoxidized dye devloper.

Dye developers, as noted above, are compounds which contain, in the same molecule, both the chromophoric system of a dye and also a silver halide developing function. By "a silver halide developing function" is meant a grouping adapted to develop exposed silver halide. A preferred silver halide development function is a hydroquinonyl group.

Multicolor images may be obtained using the color image-forming components, for example, dye developers, in an integral multi-layer photosensitive element. A suitable arrangement of this type comprises a support carrying a red-sensitive silver halide emulsion stratum, a green-sensitive silver halide emulsion stratum and a blue-sensitive silver halide emulsion stratum, said having associated therewith, respectively, for example, a cyan dye developer, a magenta dye developer and a yellow dye developer. The dye developer may be utilized in the silver halide emulsion stratum, for example, in the form of particles, or it may be disposed in a stratum (e.g., of gelatin) behind the appropriate silver halide emulsion stratum. Each set of silver halide emulsion and associated dye developer strata preferably are separated from other sets by suitable interlayers. In certain instances, it may be desirable to incorporate a yellow filter in front of the green-sensitive emulsion and such yellow filter may be incorporated in an interlayer. However, if the yellow dye developer has the appropriate spectral characteristics and is present in a state capable of functioning a a yellow filter, a separate yellow filter may be omitted.

The preparation of polymeric optical filter agents of this invention and methods for using them will be better appreciated by reference to the following Examples which are intended to be illustrative and not limitative.

EXAMPLE 1

Part A

A terpolymer of 2-hydroxypropyl methacrylate, N,N-dimethylacrylamide and acrylic acid was prepared according to the following reaction scheme:

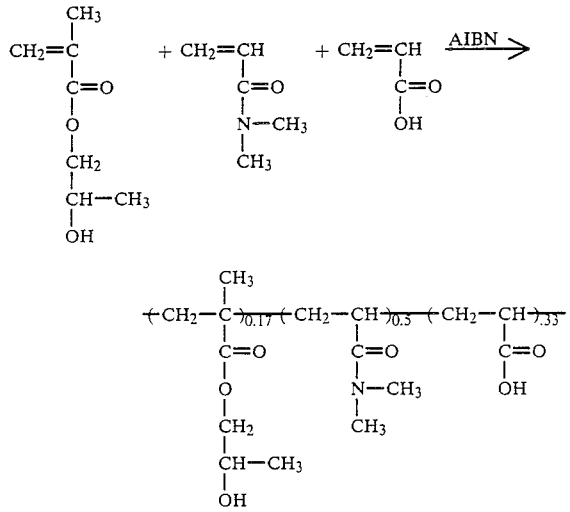

The 2-hydroxypropyl methacrylate (10.1 grams; 0.07 mole), N,N-dimethylacrylamide (20.82 grams; 0.21 mole) and acrylic acid (10.1 grams; 0.14 mole) were dissolved in 232.5 grams of dimethylformamide (DMF) that had been dried using four-Angstrom zeolitic molecular sieve material. The solution was purged for 15 minutes with nitrogen and heated to 65° C. in a 500-ml, three-neck, round-bottom flask equipped with mechanical stirrer, thermometer and a nitrogen inlet to permit application of a positive pressure of nitrogen over the solution. Azo-bis-isobutyronitrile initiator (AIBN, 0.205 gram) was quickly added to the solution and the contents of the reaction flash were stirred for 20 hours under nitrogen. The resulting polymer solution (a 15%, by weight, solution of polymer) was used directly in Part B which follows.

Part B.

A polymer derivatization (esterification) of the polymer obtained in Part A was conducted according to the following scheme:

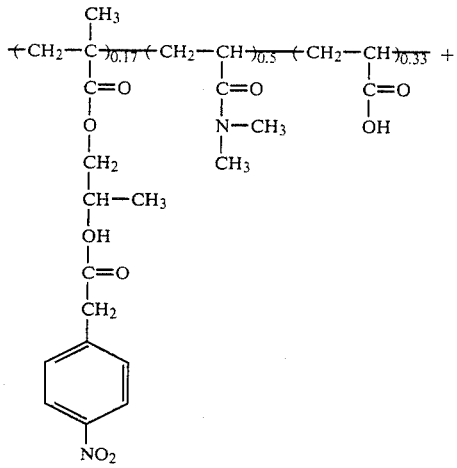

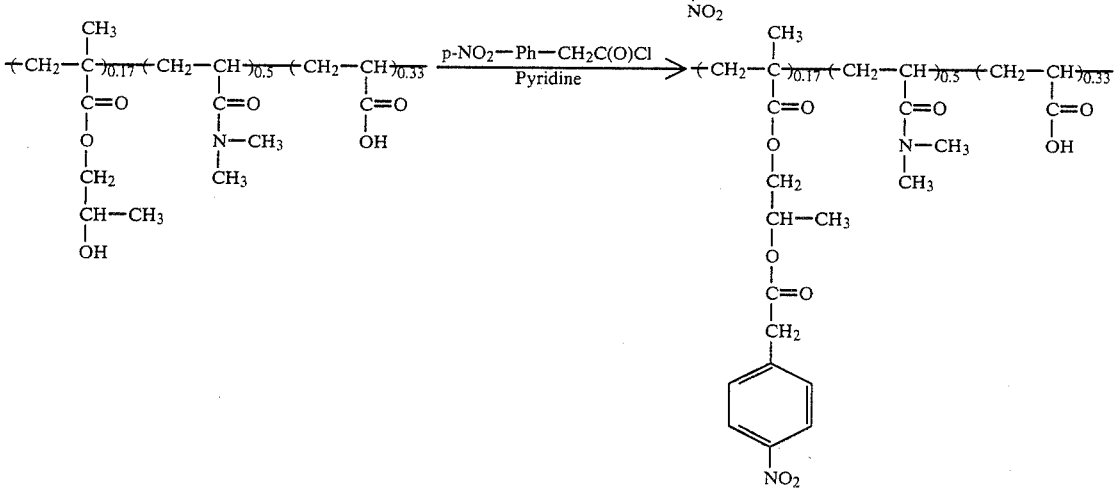

Into a 500-ml., three-neck, round-bottom flask were placed 137 grams of the polymer solution obtained in Part A above. The flask was equipped with a mechanical stirrer, thermometer and a pressure-equalizing addition funnel fitted at the top with a drying tube. To the polymer solution were added 6.6 grams (0.033 mole) of p-nitrophenyl acetyl chloride dissolved in 50 mls. of dry DMF (added over a five-minute period so as to maintain a reaction temperature of 25° C.). After stirring at room temperature for 1.5 hours, pyridine (2.7 grams; 0.033 mole), in 10 mls. of dry DMF, was added. The resulting reaction mixture was stirred at room temperature for an additional two-hour period. Although the reaction could have been stopped at this point (for recovery of the derivatized polymer), the reaction mixture was used for the conduct of the derivatization described in Part C.

Part C.

Derivatization (arylation) of the polymer obtained in Part B was performed according to the following scheme:

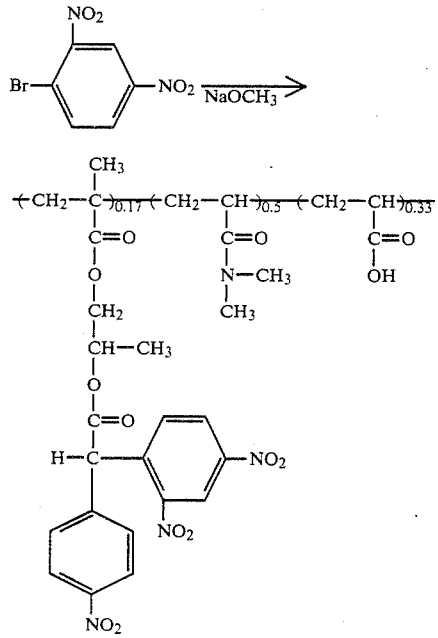

The reaction mixture obtained in Part B above was transferred to a one-liter, three-neck, round bottom flash, equipped in the same manner as the flask described in Part B. The contents of the flask were diluted with 500 mls. of dry DMF. Sodium methoxide (6.8 grams; 0.126 mole) in 50 mls. of dry DMF (an amount of sodium methoxide sufficient to ionize the p-nitrophenyl acetate moiety) was added over a five-minute period, providing a deep reddish-purple solution. To this solution were added, over a period of several minutes, 8.15 grams (0.033 mole) of 1-bromo-2,4-dinitrobenzene dissolved in 50 mls of dry DMF. The solution was observed to turn within five minutes into a deep blue-black solution. The solution was stirred at room temperature for one hour. The polymeric product was isolated by precipitation into slightly acid (pH 3) water, followed by a methanol wash. Washing was continued until thin layer chromatographic analysis of methanol extracts no longer showed the presence of low molecular weight material. The pale yellow polymer was dried in vacuo.

EXAMPLE 2

This Example illustrates the use of a pH-sensitive polymeric optical filter agent of this invention in a film unit of the type disclosed in U.S. Pat. No. 3,415,644.

In the photosensitive element of the film unit, the following cyan, magenta and yellow dye developers were used.

cyan:

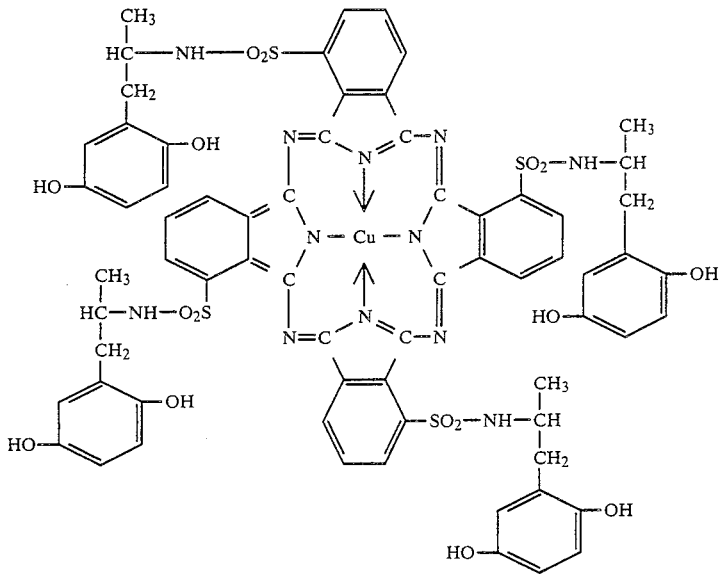

yellow:

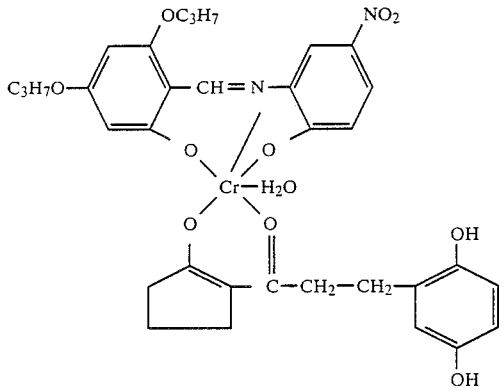

magenta:

-continued

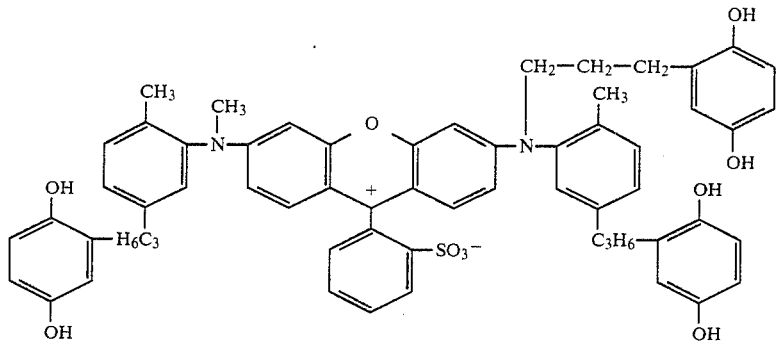

A film unit (comprising a photosensitive element, an image-receiving element and means for uniformly distributing an aqueous alkaline processing composition therebetween after photoexposure of the photosensitive element) was prepared as follows. A photosensitive element comprising an opaque polyethylene terephthalate film base containing the following layers, in sequence, was utilized:

1. a layer of cyan dye developer dispersed in gelatin and coated at a coverage of about 630 mgs./m.$^2$ of dye and about 315 mgs./m$^2$ of gelatin, and also containing about 280 mgs./m.$^2$ of diaminopurine, and about 88 mgs./m.$^2$ of 4-methylphenyl hydroquinione;

2. a red-sensitive gelatino silver iodobromide emulsion coated at a coverage of about 1054 mgs./m.$^2$ of silver and about 632 mgs./m.$^2$ of gelatin;

3. a layer of a 60-30-4-6 copolymer of butylacrylate, diacetone acrylamide, styrene and methacrylic acid and polyacrylamide coated at a coverage of about 1022 mgs./m.$^2$ of the copolymer and about 54 mgs./m.$^2$ of polyacrylamide;

4. a layer of magenta dye developer dispersed in gelatin and coated at a coverage of about 632 mgs./m.$^2$ of dye and about 316 mgs./m.$^2$ of gelatin;

5. a green-sensitive gelatino silver iodobromide emulsion coated at a coverage of about 749 mgs./m.$^2$ of silver and 330 mgs./m.$^2$ of gelatin 6. a layer containing the copolymer referred to above in layer 3 and polyacrylamide coated at a coverage of about 1653 mgs./m$^2$ of copolymer and about 163 mgs./m.$^2$ of polyacrylamide;

7. a layer of yellow dye developer dispersed in gelatin and coated at a coverage of about 659 mgs./m.$^2$ of dye and about 316 mgs./m.$^2$ of gelatin, and also containing about 108 mgs./m.$^2$ of diaminopurine;

8. a blue-sensitive gelatino silver iodobromide emulsion layer including 4'-methylphenyl hydroquinone coated at a coverage of about 1049 mgs./m.$^2$ of silver, about 525 mgs./m.$^2$ of gelatin and about 258 mgs./m.$^2$ of 4'-methylphenyl hydroquinone;

9. a layer of gelatin coated at a coverage of about 320 mgs./m.$^2$ of gelatin; and 10. a layer of optical filter agents coated from an aqueous 4/1 by weight solution of the polymer of Example 1 hereof and a polymer having the repeating units of formula (XXIV), said polymers being coated at coverages, respectively, of 4306 mgs./m.$^2$ and 1076 mgs./m.$^2$.

Following photoexposure of the aforesaid photosensitive element to provide a developable image, the photoexposed element and the aforesaid image-receiving element were superposed in face-to-face relation with their respective supports outermost. A rupturable container retaining an alkaline processing composition was fixedly mounted between the respective superposed elements at the leading edge to provide a film unit. The rupturable container, comprised of an outer layer of lead foil and an inner layer of polyvinylchloride, was provided with a marginal seal of predetermined weakness such that passage of the leading edge of the film unit into and through a pair of pressure rollers would effect a rupture of each seal and uniform distribution of the aqueous processing composition between the elements of the film unit. The rupturable container retained an aqueous alkaline processng composition having the following composition:

| COMPONENT | WEIGHT (GRAMS) |
|---|---|
| Potassium hydroxide aqueous solution (45% by wt. conc.) | 342 |
| Titanium Dioxide | 1200 |
| Viscosity-increasing agent-oxime of poly(diacetone acrylamide) | 27.2 |
| N—phenethyl α-picolinium bromide | 90 |
| 3,5-dimethyl pyrazole | 6 |
| Water | 1764 |

For purposes of evaluating the opacification capability of the pH-sensitive optical filter agents of the present invention, comparable film units as aforedescribed were developed, respectively in the dark and under conditions of ambient light and the $D_{min}$ and $D_{max}$ values of the respective images were examined for detection of decrease in such values in the case of in-light processing as compared to such values in the case of processing in the dark. In one case, the film unit (Film Unit A) was passed in the dark through a pair of rollers having a 0.0026 inch (0.067 mm.) mechanical gap and allowed to remain in the dark for 30 seconds at which time the film unit was subjected to ambient room light. In a second case, the film unit (Film Unit B) was passed in the dark through the same rollers but immediately thereafter subjected to ambient room light. The following results were obtained:

| | $D_{min}$ | | | $D_{max}$ | | |
|---|---|---|---|---|---|---|
| | R | G | B | R | G | B |
| Film Unit A (30" dark/room light) | 0.14 | 0.25 | 0.40 | 2.13 | 2.50 | 2.18 |
| Film Unit B (room light) | 0.14 | 0.18 | 0.43 | 1.53 | 1.76 | 1.76 |

Satisfactory opacification was obtained in the case of both Film Units A and B, as evident from the results set forth above and the production of good multicolor photographic images.

A control film unit, utilizing a photosensitive element as above-described but having no layer 10 (of optical filter agent), was processed through the mechanical rollers at a 0.0026 inch (0.067 mm.) gap and into ambient light. The result was that the photosensitive element was badly fogged.

EXAMPLE 3

A photographic film unit (Film Unit C) was prepared and processed in the manner described in EXAMPLE 2, except that, in place of the layer (#10) of the photosensitive element there described, there was used a layer comprising a 4/1 by weight mixture of the polymeric optical filter agent of EXAMPLE 1 and a polyoxyethylene polyoxypropylene block copolymer of about 12,500 average molecular weight, commercially available under the tradename "Pluoronic F-127" from BASF Wyandotte Corporation, the polymers be coated at coverages, respectively, of 4306 mgs./m.$^2$ and 1076 mgs./m.$^2$.

The following results were obtained

| | $D_{min}$ | | | $D_{max}$ | | |
|---|---|---|---|---|---|---|
| | R | G | B | R | G | B |
| Film Unit C (room light) | 0.19 | 0.22 | 0.27 | 1.65 | 1.49 | 1.23 |

Film C, while providing somewhat lower densities than observed in the case of Film B (using a combination of optical filter agents), was satisfactorily opacified by the layer of optical filter agent of the invention.

What is claimed is:

1. A photosensitive article comprising a support, a photosensitive photographic emulsion system comprising at least one photosensitive layer, and a transparent layer of a polymeric optical filter agent adapted upon contact with alkali to conversion to a substantially opaque layer, said photosensitive article being adapted to permit photoexposure of said photosensitive photographic emulsion system through said transparent layer of polymeric optical filter agent, said transparent layer of polymeric optical filter agent comprising a polymeric backbone having pendant therefrom a plurality of moieties of the formula

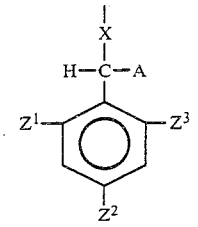

wherein X is

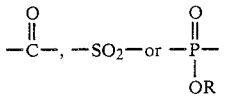

and R is alkyl, aryl, alkaryl or aralkyl; A is hydrogen, alkyl or the radical

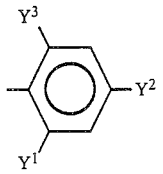

where each of $Y^1$, $Y^2$ and $Y^3$ is hydrogen or an electron-withdrawing group; and each of $Z^1$, $Z^2$ and $Z^3$ is hydrogen or an electron-withdrawing group; with the proviso that, when each of $Z^1$, $Z^2$ and $Z^3$ is hydrogen, said A is a radical

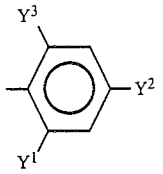

wherein at least one of said $Y^1$, $Y^2$ and $Y^3$ groups comprises an electron-withdrawing group.

2. The photosensitive article of claim 1 wherein said support is a transparent support.

3. The photosensitive article of claim 2 wherein said photosensitive photographic emulsion system is carried on one side of said transparent support and said transparent transparent layer of polymeric optical filter agent adapted to conversion to said substantially opaque layer is positioned on the opposed side of said support.

4. The photosensitive article of claim 1 wherein there are present, in superposed relation on said support, said photosensitive photographic emulsion system and said transparent layer of polymeric optical filter agent adapted to conversion to said substantially opaque layer.

5. The photosensitive article of claim 4 wherein said photosensitive system comprises a blue-sensitive silver halide emulsion layer, a green-sensitive silver halide emulsion layer and a red-sensitive silver halide emulsion layer, each said emulsion layer being in association, respectively, with a yellow dye developer layer, a magenta dye developer layer and a cyan dye developer layer.

6. The photosensitive article of claim 1 wherein there is included means for reducing the environmental pH of said article, after exposure of said photosensitive system and conversion with said alkali to said substantially opaque layer, from a pH above the pKa of said polymeric optical filter agent to a pH below the pKa of said optical filter agent.

7. The photosensitive article of claim 1 wherein there is included means for distributing an aqueous alkaline processing composition, said aqueous alkaline processing composition being effective to convert said transparent layer of polymeric optical filter agent to a substantially opaque layer.

8. The photosensitive article of claim 1 wherein, in said pendant moieties, X is

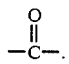

9. The photosensitive article of claim 1 wherein said transparent layer of polymeric optical filter agent compises a polymer having repeating units of the formula

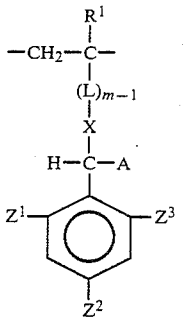

wherein $R^1$ is hydrogen, halogen or alkyl; L is an organic linking group; m is an integer one or two; X is

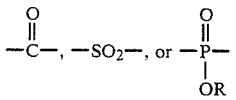

and R is alkyl, aryl, alkaryl or aralkyl; A is hydrogen, alkyl or the radical

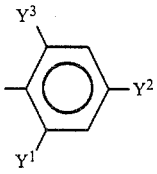

where each of $Y^1$, $Y^2$ and $Y^3$ is hydrogen or an electron-withdrawing group; and each of $Z^1$, $Z^2$ and $Z^3$ is hydrogen or an electron-withdrawing group; with the proviso that, when each of $Z^1$, $Z^2$ and $Z^3$ is hydrogen, said A is a radical

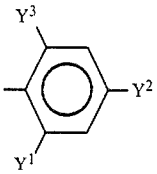

wherein at least one of said $Y^1$, $Y^2$ and $Y^3$ groups comprises an electron-withdrawing group.

10. The photosensitive article of claim 9 wherein, in said repeating units, L is a divalent radical of the formula

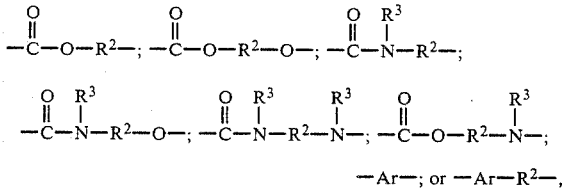

wherein, in each said divalent radical, $R^2$ represents a divalent alkylene radical and $R^3$ is hydrogen, alkyl, aryl, alkaryl or aralkyl.

11. The photosensitive article of claim 10 wherein, in said repeating units, m is two and L is a divalent radical of the formula

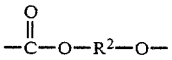

wherein $R^2$ is a divalent alkylene group.

12. The phosensitive article of claim 11 wherein $Z^1$ and $Z^2$ are each nitro, $Z^3$ is hydrogen and A is a radical of the formula

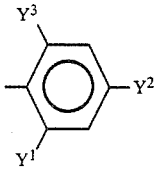

wherein $Y^1$ and $Y^3$ are each hydrogen and $Y^2$ is nitro.

13. The photosensitive article of claim 1 including an image-receiving layer.

14. A photographic film unit for forming a diffusion transfer image which comprises in combination:

a photosensitive element comprising an opaque support carrying at least one photosensitive silver halide emulsion layer, each said silver halide emulsion layer having associated therewith a dye image-forming material; an image-receiving element comprising a transparent support carrying at least a polymeric image-receiving layer dyeable by said dye image-forming material, said image-receiving element being adapted to exposure therethrough of said photosensitive element and being in a superposed fixed relation to said photosensitive element with said supports outermost; a rupturable container releasably holding an aqueous alkaline processing composition, said rupturable container being positioned so as to release said processing composition for distribution between said dyeable polymeric layer and said photosensitive element adjacent thereto upon application of pressure to said container after photoexposure of said photosensitive element; and disposed in said film unit in said processing composition and/or in a layer intermediate said photosensitive element and said image-receiving element, a polymeric optical filter agent having a light-absorbing capability at a pH above the pKa of the optical filter agent effective to absorb at least a portion of actinic radiation within a predetermined range, said polymeric optical filter agent comprising a polymeric backbone having pendant therefrom a plurality of moieties of the formula

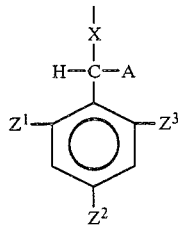

wherein X is

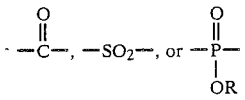

and R is alkyl, aryl, alkaryl or aralkyl; A is hydrogen, alkyl or the radical

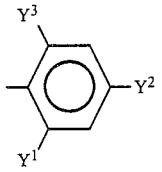

where each of $Y^1$, $Y^2$ and $Y^3$ is hydrogen or an electron-withdrawing group; and each of $Z^1$, $Z^2$ and $Z^3$ is hydrogen or an electron-withdrawing group; with the proviso that, when each of $Z^1$, $Z^2$ and $Z^3$ is hydrogen, said A is a radical

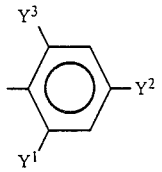

wherein at least one of said $Y^1$, $Y^2$ and $Y^3$ groups comprises an electron-withdrawing group.

15. The film unit of claim 14 wherein said polymeric optical filter agent comprises a plurality of repeating units of the formula

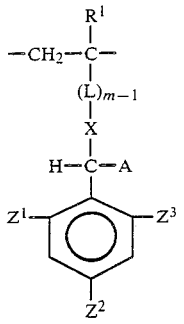

wherein $R^1$ is hydrogen, halogen of alkyl; L is an organic linking group; m is an integer one or two; X is

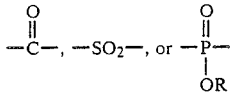

and R is alkyl, aryl, alkaryl or aralkyl; A is hydrogen, alkyl or the radical

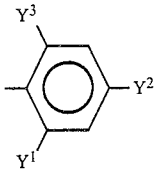

where each of $Y^1$, $Y^2$ and $Y^3$ is hydrogen or an electron-withdrawing group; and each of $Z^1$, $Z^2$ and $Z^3$ is hydrogen or an electron-withdrawing group; with the proviso that, when each of $Z^1$, $Z^2$ and $Z^3$ is hydrogen, said A is a radical

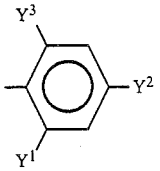

wherein at least one of said $Y^1$, $Y^2$ and $Y^3$ groups comprises an electron-withdrawing group.

16. The film unit of claim 15 wherein, in said repeating units, L is a divalent radical of the formula

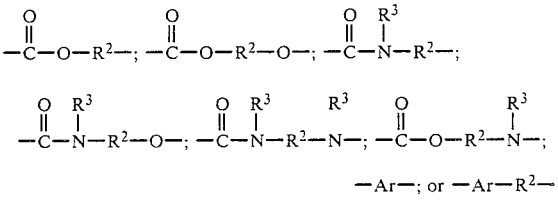

wherein, in each said divalent radical, $R^2$ represents a divalent alkylene radical and $R^3$ is hydrogen, alkyl, aryl, alkaryl or aralkyl.

17. The film unit of claim 16 wherein, in said repeating units, m is two and L is a divalent radical of the formula

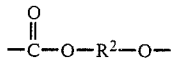

wherein $R^2$ is a divalent alkylene group.

18. The film unit of claim 17 wherein, in said repeating units, $Z^1$ and $Z^2$ are each nitro, $Z^3$ is hydrogen and A is a radical of the formula

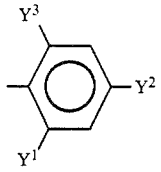

wherein $Y^1$ and $Y^3$ are each hydrogen and $Y^2$ is nitro.

19. The film unit of claim 18 wherein said polymeric optical filter agent includes repeating units from an ethylenically unsaturated copolymerizable monomer.

20. The film unit of claim 14 wherein said polymeric optical filter agent is contained in a layer permeable to aqueous processing composition and positioned intermediate said photosensitive element and said image-receiving element through which said photosensitive material is photoexposed.

21. The film unit of claim 14 wherein said polymeric optical filter agent contained in said layer permeable to aqueous processing composition is disposed at a pH below the pKa of the polymeric optical filter agent.

22. The film unit of claim 21 wherein there is included means for reducing the environmental pH of said film unit after photoexposure of said photosensitive element and application of an aqueous alkaline processing composition from a pH above the pKa of said polymeric optical filter agent to a predetermined pH below the pKa of said polymeric optical filter agent.

23. The film unit of claim 14 wherein said polymeric optical filter agent is contained in said aqueous alkaline processing composition.

24. The film unit of claim 23 wherein said polymeric optical filter agent is disposed in said aqueous alkaline processing composition at a pH above the pKa of said polymeric optical filter agent.

25. The film unit of claim 14 wherein said aqueous alkaline processing composition includes a reflecting agent effective upon distribution between said photosensitive and image-receiving elements to provide a background for the viewing of said transfer image in said image-receiving layer.

26. The film unit of claim 25 wherein said reflecting agent taken together with said polymeric optical filter agent are adapted to prevent further exposure of the selectively photoexposed silver halide layer during processing in the presence of radiation within said predetermined wavelength range actinic to the photosensitive element and incident thereto from the side of the film unit opposed to said opaque support.

27. A photographic process for forming a diffusion transfer image which comprises, in combination, the steps of:

(a) photoexposing a photographic film unit which comprises a plurality of layers including a photosensitive silver halide layer having associated therewith a compound capable of providing as a function of development an imagewise distribution of an image-forming material which is processing composition soluble and diffusible as a function of the point-to-point degree of exposure of said silver halide layer and a diffusion transfer process image-receiving layer adapted to receive solubilized image-forming material diffusing thereto;

(b) contacting said photosensitive silver halide layer with an aqueous alkaline processing composition to provide an optical filter agent in a form capable of absorbing a predetermined wavelength range of radiation actinic to said photosensitive material, said optical filter agent being a polymeric optical filter agent comprising a polymeric backbone having pendant therefrom a plurality of moieties of the formula

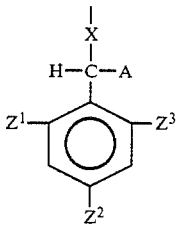

wherein X is

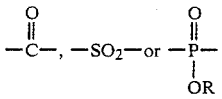

and R is alkyl, aryl, alkaryl or aralkyl; A is hydrogen, alkyl or the radical

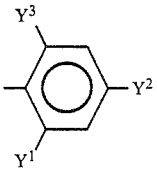

where each of $Y^1$, $Y^2$ and $Y^3$ is hydrogen or an electron-withdrawing group; and each of $Z^1$, $Z^2$ and $Z^3$ is hydrogen or an electron-withdrawing group; with the proviso that, when each of $Z^1$, $Z^2$ and $Z^3$ is hydrogen, said A is a radical

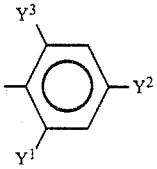

wherein at least one of said $Y^1$, $Y^2$ and $Y^3$ groups comprises an electron-withdrawing group; said polymeric optical filter agent having a light-absorbing capability at a pH above the pKa of said optical filter agent;

(c) effecting substantial development of said silver halide emulsion;

(d) forming an imagewise distribution of diffusible image-forming material, as a function of the point-to-point degree of emulsion exposure; and (e) transferring, by diffusion, at least a portion of said imagewise distribution of diffusible image-forming material to said layer adapted to receive said material to provide an image therein; said optical filter agent being present during development in a position and quantity effective to absorb at least a portion of incident actinic radiation within said predetermined range.

28. The photographic process of claim 27 wherein said polymeric optical filter agent is contained in a layer permeable to aqueous processing composition and positioned between said photosensitive element and a layer of said film unit through which said photosensitive material is exposed.

29. The photographic process of claim 28 wherein said polymeric optical filter agent contained in said layer permeable to aqueous processing composition is prior to said application of processing composition disposed at a pH below the pKa of the polymeric optical filter agent.

30. The photographic process of claim 29 wherein, subsequent to said application of said processing composition, said polymeric optical filter agent is present at a pH above the pKa of said polymeric optical filter agent and in said form capable of absorbing actinic radiation within said predetermined wavelength range and wherein, upon substantial completion of development of said photoexposed element, the environmental pH of said process is reduced to a pH below the pKa of said polymeric optical filter agent.

31. The process of claim 28 wherein said polymeric optical filter agent comprises repeating units having the formula

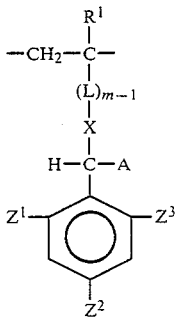

wherein $R^1$ is hydrogen, halogen or alkyl; L is an organic linking group; m is an integer one or two; X is

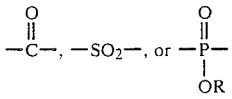

and R is alkyl, aryl, alkaryl or aralkyl; A is hydrogen, alkyl or the radical

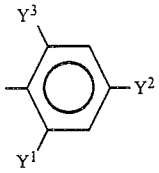

where each of $Y^1$, $Y^2$ and $Y^3$ is hydrogen or an electron-withdrawing group; and each of $Z^1$, $Z^2$ and $Z^3$ is hydrogen or an electron-withdrawing group; with the priviso that, when each of $Z^1$, $Z^2$ and $Z^3$ is hydrogen, said A is a radical

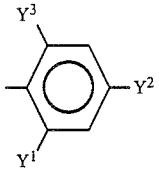

wherein at least one of said $Y^1$, $Y^2$ and $Y^3$ groups comprises an electron-withdrawing group.

32. The process of claim 31 wherein, in said repeating units, L is a divalent radical of the formula

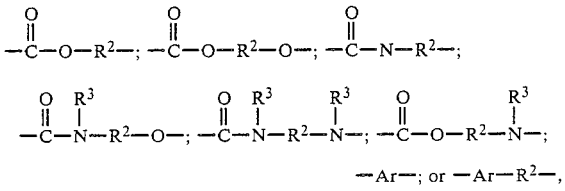

wherein, in each said divalent radical, $R^2$ represents a divalent alkylene radical and $R^3$ is hydrogen, alkyl, aryl, alkaryl or aralkyl.

33. The process of claim 32 wherein m is two and L is a divalent radical of the formula

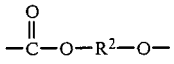

wherein $R^2$ is a divalent alkylene group.

34. The process of claim 33 wherein $Z^1$ and $Z^2$ are each nitro, $Z^3$ is hydrogen and A is a radical of the formula

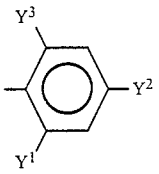

wherein $Y^1$ and $Y^3$ are each hydrogen and $Y^2$ is nitro.

35. The process of claim 34 wherein said polymeric optical filter agent includes repeating units from an ethylenically unsaturated copolymerizable monomer.

* * * * *